US011813493B2

(12) United States Patent
Sjöblom

(10) Patent No.: US 11,813,493 B2
(45) Date of Patent: Nov. 14, 2023

(54) WEIGHT LIFTING DEVICE

(71) Applicant: Pecwell Oy, Nahkela (FI)

(72) Inventor: Paavo Valta Henrik Sjöblom, Nahkela (FI)

(73) Assignee: Pecwell Oy, Nahkela (FI)

( * ) Notice: Subject to any disclaimer, the term of this patent is extended or adjusted under 35 U.S.C. 154(b) by 54 days.

(21) Appl. No.: 17/584,955

(22) Filed: Jan. 26, 2022

(65) Prior Publication Data

US 2023/0271049 A1 Aug. 31, 2023

(51) Int. Cl.
*A63B 21/062* (2006.01)
*A63B 21/072* (2006.01)

(52) U.S. Cl.
CPC ..... *A63B 21/0632* (2015.10); *A63B 21/063* (2015.10); *A63B 21/0724* (2013.01)

(58) Field of Classification Search
CPC ... A63B 21/06; A63B 21/062; A63B 21/0624; A63B 21/0626; A63B 21/0628; A63B 21/063; A63B 21/0632; A63B 21/0724
See application file for complete search history.

(56) References Cited

U.S. PATENT DOCUMENTS 5,669,859 A * 9/1997 Liggett ..... A63B 21/0626 482/94
7,374,516 B2 * 5/2008 Lundquist ..... A63B 21/0783 482/106
7,549,950 B1 * 6/2009 Lundquist ..... A63B 21/0783 482/106
7,666,124 B2 * 2/2010 Vaes ..... A63B 21/156 482/135
10,245,461 B2 * 4/2019 Bruni ..... A63B 21/0783
10,864,400 B2 * 12/2020 Schween ..... A63B 21/0626
(Continued)

FOREIGN PATENT DOCUMENTS

CN 201304207 9/2009
CN 111214807 A 6/2020
EP 0194220 A1 9/1986

OTHER PUBLICATIONS

European Patent Office, Extended European Search Report, Application No. EP22213836, dated Jun. 19, 2023, 9 pages.

*Primary Examiner* — Joshua Lee
(74) *Attorney, Agent, or Firm* — ZIEGLER IP LAW GROUP LLC

(57) ABSTRACT

A weight lifting device including a housing having first frame having first vertical channel for accommodating first weight holding means, and second frame having second vertical channel for accommodating second weight holding means, wherein first vertical channel and second vertical channel are dimensioned so that first weight holding means and second weight holding means can move up and down, when in use, in first vertical channel and second vertical channel, respectively. The weight lifting device also includes a handle bar pivotably connectable to first weight holding means and to second weight holding means from first end of handle bar and second end of handle bar, respectively. The weight lifting device further includes at least one of: first holding bar, second holding bar, first pivotable arm, and second pivotable arm, arranged between pivotably connectable handle bar and first weight holding means and second weight holding means.

14 Claims, 7 Drawing Sheets

(56) References Cited

U.S. PATENT DOCUMENTS

| | | | | |
|---|---|---|---|---|
| 2005/0202941 | A1* | 9/2005 | Vaes | A63B 21/0628 482/94 |
| 2007/0042876 | A1* | 2/2007 | Lundquist | A63B 21/078 482/94 |
| 2017/0080277 | A1 | 3/2017 | Rogers | |

* cited by examiner

WEIGHT LIFTING DEVICE

TECHNICAL FIELD

The present disclosure relates generally to devices employed in strength training; and more specifically, to improved weight lifting devices that provide combined benefits of Smith machines and free lifting.

BACKGROUND

In recent times, weight training has become a popular strength training activity worldwide. Various health clubs, gymnasiums, parks, hotels, residential complexes, and private homes offer a dedicated space with a wide array of weight training equipment besides other activities or sports equipment. Moreover, users from varying age groups, having varying physical abilities and goals engage in weight training for keeping themselves active and fit, and/or developing their physical strengths and muscles. Notably, weight training provides benefits such as increased muscle, tendon and ligament strength, bone density, flexibility, optimum metabolic rate, and postural support.

Traditionally, people lifted free weights in order to improve their balance, strength, and endurance of muscles. Typically, the free weights may include dumbbells, barbells, medicine balls, sand bells, kettlebells, and the like. With advances in Physical Science, free lifting training has been availed to interested users. Free lifting training allows users to focus on training all muscles. However, free lifting training involves the risk of dropping the weights, such as on the floor, over the user, or hurting someone else in the vicinity. Moreover, the risk could also include injuring the back or any other body part of the user if the lifting is done in the wrong way. Normally, the users often seek assistance from another person, that serves as a spotter, to spot a dropping free weight. However, the spotter may also fail to handle or prevent the accidental dropping of the free weights.

Conventionally, a Smith machine is widely used to perform weight training safely without the assistance of a spotter. Notably, the Smith machine prevents a loaded weight from injuring the user in an event of a failed lift. Therefore, Smith machines are often preferred by casual or inexperienced strength trainers who do not understand free weight training with heavy weights, without requiring a spotter or a trainer. However, the structure of the Smith machine limits the movements and training of all muscles. Basically, with the Smith machine, the user could only lift weights up and down as the weigh bar therein is always horizontal, thereby limiting the training to pre-defined trajectories. This limits the types of movements as well as targets only specific muscle groups. Moreover, users of the Smith machines are susceptible to injuring their knees, shoulders or back due to the sheer stress thereon while training on Smith machines.

Furthermore when comparing free lifting and Smith machines it has been found out for example that there is significantly greater activation of the medial deltoid in the free weight bench press than in the Smith machine bens press. Benefit over free lifting to traditional Smith machine is due to instability caused by the fee weight lifting requires to use of medial deltoid to bot stabilize the body and produce the force necessary to lift the weight. In deed when using Smith machine type of arrangements it is possible to gain exercise to certain muscle groups, however since there is no need to compensate instabilities during lifting some of the muscle groups are left almost untrained.

Therefore, in light of the foregoing discussion, there exists a need to overcome the aforementioned drawbacks associated with conventional weight training equipment for a safe and improved weight training targeting all the user's muscles.

SUMMARY

The present disclosure seeks to provide a weight lifting device. The present disclosure seeks to provide a solution to the existing problem of strength training of all the muscles of a user. An aim of the present disclosure is to provide a solution that overcomes at least partially the problems encountered in prior art, and provides an improved weight lifting device providing combined benefits of a Smith machine and free lifting.

In an aspect, an embodiment of the present disclosure provides a weight lifting device comprising:

- a housing, having
  - a first frame having a first vertical channel for accommodating a first weight holding means, and
  - a second frame having a second vertical channel for accommodating a second weight holding means,
- wherein the first vertical channel and the second vertical channel are dimensioned so that the first weight holding means and the second weight holding means can move up and down, when in use, in the first vertical channel and the second vertical channel, respectively and
- a handle bar pivotably connectable to the first weight holding means and to the second weight holding means from a first end of the handle bar and a second end of the handle bar, respectively.

Embodiments of the present disclosure substantially eliminate or at least partially address the aforementioned problems in the prior art, and enable better weight training that targets all of the user's muscles using an improved weight lifting device. The weight lifting device combines benefits achieved from Smith machines and free lifting. In this regard, the user could perform various movements to train all muscles thereof, unlike the conventional weight training equipment. Additionally, the weight lifting device enables the user to lift weights similar to free lifting training, while still reducing the risk of dropping the weights or injuring the user. In this regard, the weight training device is provided with a weight lifting bar (namely, the handle bar) pivotably connectable with the weight holding means (namely, the first and the second weight holding means) to enable the users to make free lifting type movements. It will be appreciated that the handle bar may be pivotably connectable to the first and second weight holding means by fasteners, ball bearings, spring elements, additional pieces of rods (such as holding bars, pivotable arms, and so forth).

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein.

Figure 1:
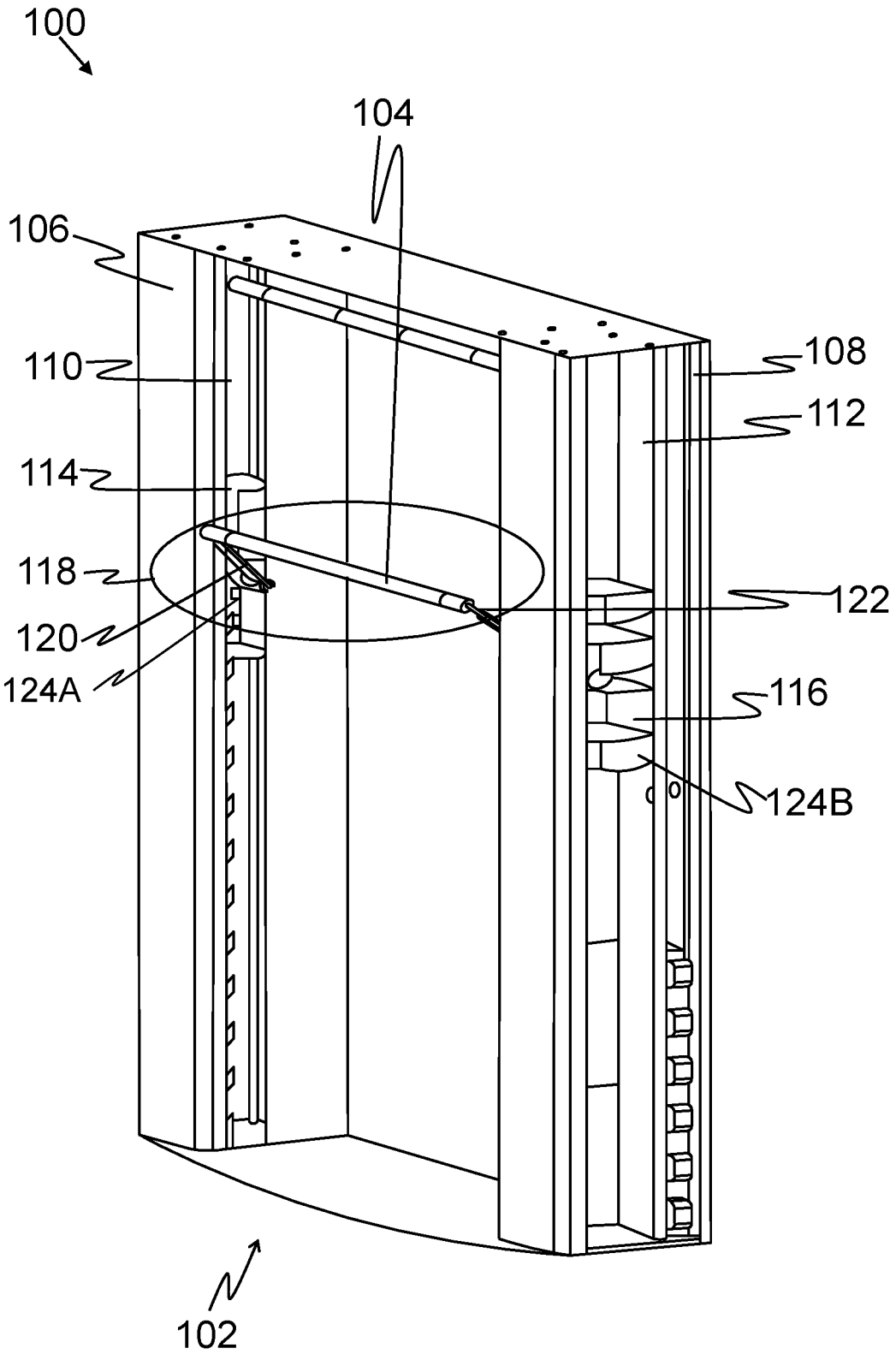
FIG. 1 is a schematic illustration of a weight lifting device, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also possible.

In an aspect, an embodiment of the present disclosure provides a weight lifting comprising:

- a housing, having
  - a first frame having a first vertical channel for accommodating a first weight holding means, and
  - a second frame having a second vertical channel for accommodating a second weight holding means,
- wherein the first vertical channel and the second vertical channel are dimensioned so that the first weight holding means and the second weight holding means can move up and down, when in use, in the first vertical channel and the second vertical channel, respectively; and
- a handle bar pivotably connectable to the first weight holding means and to the second weight holding means from a first end of the handle bar and a second end of the handle bar, respectively.

The present disclosure provides the aforementioned weight lifting device. The weight lifting device is versatile and enables better training of all the muscles of a user. The weight lifting device eliminates limitations, such as limiting training to pre-defined trajectories, and training a specific set of muscles, that are typically associated with the conventional weight training devices. Beneficially, the disclosed weight training device is provided with pivotable arms that connects the handle bar with the weight holding means to provide higher freedom of movement to the user. Additionally, the weight holding means are preferably arranged inside the housing to prevent the weights from dropping accidentally, thereby providing safety to the user. Moreover, the weight lifting device employs a blocking mechanism (namely, locking mechanism) to prevent excess tilting of the handle bar, thereby, reducing the risk of dropping the handle bar down.

The disclosed weight lifting device provides a solution for performing better strength training of all muscles of a user. The term "weight lifting device" as used herein refers to a mechanical device that works in conjunction with several accessories (such as bars, and attachments to support, fix or anchor the weight lifting device) used for strength training by the user thereof. Specifically, the user lifts weights arranged on the weight lifting device to train a plurality of muscles, preferably all the muscles, thereof. Beneficially, the weight lifting device combines benefits achieved from the existing Smith machines and free lifting. Additionally, beneficially, the weight lifting device ensures targeting all muscles of the body of the user, unlike the conventional techniques of weight lifting that target only a specific group of muscles. The term "user" as used herein refers to a person training on the weight lifting device to strengthen muscles thereof. It will be appreciated that the users may belong to any age group, have varying physical abilities and goals.

The term "weight" as used herein refers to an object designed for lift-type physical exercises by the user for training the muscles thereof. Optionally, the weight may be a heavy object made of metal (such as a cast iron), an alloy of metals, a rubber, a rigid plastic, or any combination thereof. The weights may be individually held by the user, in a pair of weights or in a set of weights. It will be appreciated that while lifting weights, equal weights may be place on both sides of an attachment means, such as a bar or rack, thereby allowing movement of user's muscles in different directions. Optionally, the weights may be arranged on the weight lifting device that may be used by users to perform various physical exercises, including, but not limited to, for example bench press, military press, seated press, squat, lunge, shrug, and so forth.

In this regard, the weight lifting device comprises a housing. The term "housing" as used herein refers to an open arrangement that is configured to accommodate several mechanical parts and equipment of the weight lifting device therein. Optionally, the housing may be implemented to have a substantially cuboidal shape, rectangular shape, or hemispherical shape, solid open arrangement having side walls joining a top side and a base side of the housing. Alternatively, the housing can be implemented to have a substantially polygonal shape having a top side and a base side of the housing.

The housing has a first frame having a first vertical channel for accommodating a first weight holding means, and a second frame having a second vertical channel for accommodating a second weight holding means. The terms "first frame" and "second frame" as used herein refer to a first side wall and a second side arranged parallel and opposite the first side wall. The first frame and the second frame may be of equal length and are arranged to join the top side and the base side of the housing. It will be appreciated that the first frame and the second frame are separated by a pre-defined distance therebetween (such as, for example, a width of 2 meters). Each of the first frame and the second frame may have a substantially open side. Moreover, the first frame and the second frame are arranged facing each other, such that the open sides of the first and second frames face each other, forming inner sides thereof. Moreover, the open sides are designed as vertical channels corresponding to the first and second frames, respectively.

The terms "first vertical channel" and the "second vertical channel" as used herein refer to vertical passages within the inner side of the first frame and the second frame, respectively. Optionally, the first vertical channel and the second vertical channel are designed to allow the weights to be lifted up and down with respect to the ground. The first vertical channel and the second vertical channel may at least partly house mechanics that allows the user to lift weights up and down with respect to the ground. Optionally, the first vertical channel and the second vertical channel may have cables or adjustable pulleys to enable the movement of weights and associated mechanics of the weight lifting device. Moreover, the first vertical channel and the second vertical channel enable the weights to move along the vertical axis inside the housing thereby allowing the user to perform the strength training exercises. It will be appreciated that the first vertical channel accommodates a first weight holding means and the second vertical channel accommodates a second weight holding means.

Optionally, each of the first and second vertical channels may have a guiding means comprising a pair of guiding rods and a sliding element. The pair of guiding rods are arranged at a pre-defined distance from walls of the first and second vertical channels and run parallel to each other inside the first and second vertical channels. The sliding element is slidably mounted on the pair of guiding rods inside the first and second vertical channels and are vertically moved up or down along the corresponding guiding rods when the user is training on the weight lifting device.

The term "first weight holding means" and the "second weight holding means" as used herein refer to a space for holding weights inside the first vertical channel and the second vertical channel, respectively. The first weight holding means and the second weight holding means enable inserting therein or removing therefrom a plurality of weights as required by the user. Beneficially, the first weight holding means and the second weight holding means provide a benefit of safety by preventing dropping of the weights, in an uncontrolled manner, on the user or on the ground or over any other person in the vicinity of the user. Preferably, the first and second weight holding means could only move up or down inside the first and second vertical channels, respectively. In this regard, the first vertical channel and the second vertical channel are dimensioned so that the first weight holding means and the second weight holding means could move up and down, when in use, in the first vertical channel and the second vertical channel. Optionally, the first weight holding means may be arranged in the first vertical channel at different height than the second weight holding means in the second vertical channel. In an alternative embodiment the first and/or second weight holding means refer to a setup in, which a first end of belt is connected to the first and/or second weight holding means and a second end of the belt is connected to either spring or a counter weight via for example pulley. The belt can refer to a line, hoist, tackle, pulley. In said embodiment the weigh holding means are holding weights in directly.

Optionally, each of the first weight holding means and the second weight holding means have slots for inserting or removing a plurality of weights. It will be appreciated that the user may vary the amount of weights by removing (or adding) weights from (or to) the first and/or second weight holding means. However, weights on the first weight holding means and the second weight holding means may be the equal while the weight lifting device is in use. In an embodiment, the first weight holding means and the second weight holding means may accommodate an equal number of weights. In another embodiment, the first weight holding means and the second weight holding means may accommodate an unequal number of weights, for example, to strengthen one side of the user body better than the other side, such as in an event of an injury the injured site may be required to be trained using lighter weights. Optionally, the weights may be inserted or removed from the first weight holding means and the second weight holding means to increase or decrease the desired total weight over the handle bar.

Moreover, the weight lifting device comprises a handle bar. The term "handle bar" as used herein refers to an elongated bar or rod, preferably made of metal, alloy of metal, rigid plastic, a suitable rigid material, or any combination thereof, that is connected with a set of weights, such as the weights arranged on the first and second weight holding means, at ends, such as a first end and a second end, thereof. The handle bar provides a holding or gripping area for the users of the weight lifting device. The handle bar may be of various cross-sections and shapes, such as for example, a straight bar or a curled bar to enable effective holding (namely, gripping) thereof by the user. Optionally, the handle bar may have a polygonal shape such as a rounded-cuboidal shape, a hexagonal shape, a rounded-hexagonal shape, a rounded-prism shape, and so forth. Optionally, the handle bar may be engraved with a knurled crosshatch pattern to enable users to maintain a solid (namely, strong) grip.

It will be appreciated that the handle bar is pivotably connectable to the first weight holding means from the first end of the handle bar and to the second weight holding means from the second end of the handle bar. The term "pivotable" as used herein refers to a capability of rotating (turning or revolving) or swinging around or about on an axis or center of object (namely, a pivot). In particular, the handle bar is pivotable about the first and second weight holding means. It will be appreciated that while the handle bar is pivotable about the first and second weight holding means, the first and second weight holding means are stationary. Moreover, pivotably connectable handle bar enables the user to move the handle bar in various directions while lifting up and lowering down the weights, by providing more degrees of freedom (namely, freedom of movement) to the handle bar. As an example pivotable handle bar enables to lift the first and second weight holding means (and thus the weights) in unsymmetrical way for example first weight holding means can be slightly higher during part of the lifting than the second weight holding means. This leads to training of muscles responsible of keeping balance of the user in addition to muscles which are used for lifting.

Optionally, the pivotably connectable handle bar and the first weight holding means and the second weight holding means provides various freedoms of movements of the handle bar in respect of the housing of the weight lifting device. The user may have freedoms of movement to perform with the lifting bar. The term "freedom of movements" as used herein refers to the total number of independent displacements or aspects of the motion of one or more mechanical component of the weight lifting device. In other words, the freedom of movement may be defined as the motion capabilities of the one or more mechanical component of the weight lifting device.

Optionally, the freedom of movement may be at least one of: an upward movement, a downward movement, sideways movement, a tilting movement, a rotating movement, or a shaking movement of the handle bar in respect of the housing of the weight lifting device. Moreover, the weight lifting device may operate in two or three dimensions but may have more than three degrees of freedom. In an example, the user, while holding from the handle bar, could rotate tilt the handle bar in respect to the horizontal level, such as to have one weight holding means (such as the first weight holing means) to be at a different height than the other weight holding means (such as the second weight holing means), or shake the handle bar in many different directions, thus enabling free weight lifting type of experience using the weight lifting device.

Optionally, the weight lifting device further comprises at least one of: a first holding bar, a second holding bar, a first pivotable arm, and a second pivotable arm, arranged between the pivotably connectable handle bar and the first weight holding means and the second weight holding means, wherein at least one of: the first holding bar, the second holding bar, the first pivotable arm, the second pivotable arm arranged with the handle bar form a lifting bar. The term "lifting bar" as used herein refers to a sequential arrangement of pivotable mechanical components connected together to enable more degrees of freedom for achieving different types of lifting movements using the weight lifting device. The mechanical components may be at least one of the first holding bar, the first pivotable arm, the second pivotable arm, the second holding bar and the handle bar that when connected together form the lifting bar, that is elongate in shape. Benefit of such an arrangement is to allow almost free lifting type of experience but still gaining safety aspects of Smith type of machine. In deed during lifting the user lifting the lifting bar it can move, up to limits of the pivotable arms, in various degrees of freedom. However the first and second vertical channels guide the weights in certain dimension making sure that the main direction of training is right thus eliminating at least partially injuries.

Optionally, the user holds the lifting bar from the handle bar that is pivotably connectable to the first weight holding means and the second weight holding means, to lift up and lower down the weights, when in use, in the first vertical channel and the second vertical channel, respectively. It will be appreciated that the holding bar is arranged at the center of the lifting bar and at a predefined distance from the housing of the weight lifting device to allow the user to lift the lifting bar from the handle bar in order to perform various physical exercises by preventing a potential injury from the housing. Optionally, the user holds the handle bar having the equal number of weights on either side thereof arranged on the first and second weight holding means, and moves the lifting bar along the vertical axis of the first and second vertical channels due to which the first weight holding means and the second weight holding means move up and down in the first vertical channel and the second vertical channel, respectively.

Moreover, each of the aforesaid mechanical components have a first end and a second end. It will be appreciated that the first end and the second end are opposite to each other and are separated by a length of the corresponding mechanical component. The terms "first holding bar" and "second holding bar" as used herein refer to cylindrical metal rod-like structures pivotably connectable to the handle bar to provide more freedom of movement to the lifting bar. Typically, the first holding bar and the second holding bar may be fabricated using material such as stainless steel as it provides high tensile strength and prevention against corrosion. The terms "first pivotable arm" and "second pivotable arm" as used herein refer to rectangular metal plate-like components that enable achieving free lifting type of movements using the lifting bar.

In an embodiment, the weight lifting device may comprises a sequential arrangement of the first holding bar, the first pivotable arm, the handle bar, the second pivotable arm, and the second holding bar to collectively form the lifting bar. In this regard, the lifting bar is formed by pivotably connecting the first holding bar to a first pivotable arm that in turn is pivotably connected to the handle bar at the first end thereof and second end of the handle bar being pivotably connected to the second pivotable arm that is in turn pivotably connected to the second holding bar. In such arrangement, the first end of the lifting bar is same as a first end of a first holding bar and the second end of the lifting bar is same as a second end of the second holding bar.

Optionally, the handle bar is pivotably connectable to:

the first weight holding means by the first holding bar and the first pivotable arm, wherein the first end of the handle bar is connected to a second end of the first pivotable arm, a first end of the first pivotable arm is connected to a second end of the first holding bar, and the first end of the first holding bar is connected to the first weight holding means; and the second weight holding means by the second holding bar and the second pivotable arm, wherein the second end of the handle bar is connected to the first end of the second pivotable arm, the second end of the second pivotable arm is connected to a first end of the second holding bar, and the second end of the second holding bar is connected to the second weight holding means, and wherein the first end of the first holding bar and the second end of the second holding bar is the first end of the lifting bar and the second end of the lifting bar, respectively.

In this regard, the first and second weight holding means are connected to the first and second holding bar. Optionally, such connectedness may be pivotably connected or non-pivotably connected (namely, tightly secured), such as by way of welding using bolts, fasteners, and the like. Additionally, the first pivotable arm may be arranged between the first holding bar and the handle bar and rotates about a pivot therein. Similarly, the second pivotable arm may be arranged between the second holding bar and the handle bar and rotates about a pivot therein. Optionally, each of the first end of the first holding bar is connected to the first weight holding means and the second end of the second holding bar is connected to the second weight holding means using ball bearings. The term "ball bearings" as used herein refers to a rolling-element bearing that uses balls to maintain the separation between the bearing races. The bearing races are rings with a groove where the balls rest. Additionally, one race may be stationary and the other may be attached to the rotating assembly (for example, a hub or shaft). In this regard, the ball bearing is used to reduce rotational friction and support radial and axial loads. Moreover, the ball bearing, while facilitating motion, serves functions such as carrying loads, reducing friction, and positioning moving parts of the weight lifting device. Furthermore, the ball bearings are used between the first holding bar and the first weight holding means and similarly between the second holding bar and the second weight holding means. The ball bearing may be selected from, but not limited to, deep-groove ball bearings, angular contact ball bearing, self-aligning ball bearing, thrust ball bearing. The ball bearings enable the first holding bar and the second holding bar to rotationally pivot in respect to the first weight holding means and the second weight holding means, respectively.

It will be appreciated that the first end of the first holding bar may rotationally pivot in respect to the first weight holding means, thus enabling rotational movement of the lifting bar in respect to the housing of the weight lifting device. Additionally, the ball bearings allow the second end of the second holding bar to rotationally pivot in respect to the second weight holding means, thus enabling rotational movement of the lifting bar with respect to the housing of the weight lifting device.

Optionally, the first end of the first holding bar may be connected to the first weight holding means and the second end of the second holding bar may be connected to the second weight holding means using roller bearings. The term "roller bearings" as used herein refers to the bearing that uses a roller to maintain the separation between the bearing races. The race is a ring with a cylindrical groove where the roller rest. The roller bearing may be selected from, but not limited to, a tapered roller bearing, spherical, roller bearing cylindrical roller bearing.

In an alternative embodiment, the weight lifting device may comprises any sequential arrangement of the at least one of: the first holding bar, the second holding bar, the first pivotable arm, the second pivotable arm, and the handle bar. Moreover, it will be appreciated that several other mechanical components may be implemented in between a first end of the lifting bar and a second end of the lifting bar to increase the freedom of movements of the lifting bar with respect to the housing of the weight lifting device.

Optionally, the handle bar is pivotably connectable to:

the first weight holding means by the first holding bar such that the first end of the handle bar is connected to a second end of the first holding bar, and the first end of the first holding bar is connected to the first weight holding means; and the second weight holding means by the second holding bar such that the second end of the handle bar is connected to a first end of the second holding bar, and the second end of the second holding bar is connected to the second weight holding means, and wherein the first end of the first holding bar and the second end of the second holding bar is the first end of the lifting bar and the second end of the lifting bar, respectively.

In this regard, the handle bar is pivotably connectable to the first holding bar and the second holding bar that are in turn connected to the first weight holding means and the second weight holding means, respectively, in a given orientation to enable a varied range of degrees of freedom of the lifting bar. Optionally, the handle bar is pivotably connected directly to the first holding bar and second holding bar at the first and second end of the handle bar, respectively, to enable movement but with lower degrees of freedom. The said arrangement is used for enabling horizontal tilting of the lifting bar of the weight lifting device. Beneficially, this arrangement may decrease the number of mechanical components of the weight lifting device, while still allowing the user to perform lifting exercises requiring comparatively lower degrees of freedom as compared to the arrangement additionally having the first and second pivotable arms to form the lifting bar.

Optionally, the first end of the handle bar is connected to a second end of the first holding bar and the second end of the handle bar is connected to a first end of the second holding bar using fasteners. The term "fasteners" as used herein refers to a hardware component that mechanically joins or affixes two or more objects/components together. Moreover, the fasteners are used to create non-permanent joints that could be removed or dismantled without damaging the joining components of the weight lifting device. It will be appreciated that the handle bar ends in an elongated opening in which fasteners are arranged to allow the movement (such as sliding) of the handle bar in respect to the first holding bar and the second holding bar of the weight lifting device. Furthermore, the fastener may be a threaded fastener having an internal or external screw threads. Optionally, the fasteners may be screws, nuts, bolts, rivets, and anchors, or studs. Specifically, the bolt is a form of a threaded fastener with an external thread requiring a matching pre-formed thread such as the nut having complementary threads. Optionally, the handle bar may be connected to the first holding bar and the second holding bar at the first end and the second end of the handle bar using for example bolts.

Optionally, each of the first pivotable arm and the second pivotable arm comprises a protruding portion at the first end of the first pivotable arm and the second end of the second pivotable arm, respectively, to prevent excess tilting of the handle bar with respect to the housing of the weight lifting device. The term "protruding portion" as used herein refers to a piece of metal that protrudes (namely, extends) from the first pivotable arm and the second pivotable arm to act as a stopper in a mechanical arrangement. In this regard, the protruding portion may be used to prevent excess tilting of the handle bar with respect to the housing of the weight lifting device and prevents the handle bar from striking with the housing with a potential jerk, for example. Beneficially, the excess tilting may cause injury to the user's muscles due to the jerk. Furthermore, the protruding portion may be made of metal, alloy, or any solid material of different shapes and sizes depending upon the function and usage thereof.

Optionally, each of the first holding bar and the second holding bar comprise a locking mechanism. The term "locking mechanism" as used herein refers to a mechanical system that assists the coupling and uncoupling of two mechanical components and the fixation of the two mechanical components in an operating position. Moreover, a first locking mechanism is preferably permanently attached to the first holding bar and a second locking mechanism is preferably permanently attached to the second holding bar. In this regard, the locking mechanism is attached to the first holding bar and the second holding bar such that the first locking mechanism and the second locking mechanism rotate with the rotation of the first holding bar and the second holding bar.

Optionally, the locking mechanism of each of the first holding bar and the second holding bar locks into a corresponding indentation within the first vertical channel and the second vertical channel, respectively, when the handle bar is rotated upon use. The term "indentation" as used herein refers to a slot for retaining the locking mechanism of each of the first holding bar and the second holding bar in an event of accidental drop of the handle bar by the user. Optionally, the indentation is complementary to the size of the corresponding locking mechanism or slightly bigger as compared to the corresponding locking mechanism. Herein, it will be appreciated that the term "slightly bigger" is meant bigger by within +10% in physical dimensions, more optionally to within +5% in physical dimensions, and within +10° in the angle of projection, more optionally to within +5° in the angle of projection. In an example, when the handlebar is rotated (such as in a clockwise or an anticlockwise direction) the first locking mechanism and the second locking mechanism of the first holding bar and the second holding bar respectively may go into the corresponding indentation within the first vertical channel and the second vertical channel to stop the weights and the handle bar from dropping down accidentally or with a jerk. Furthermore, the weight lifting device may have a plurality of complementary indentation with respect to the first locking mechanism and the second locking mechanism, at different predetermined heights, to provide the user to lock the handle bar therein when not in use. Optionally, the indentation may be implemented as a notch or a cleft within each of the first and second vertical channels of the weight lifting device. In an example, the user may lock the handle bar into one of the notches or clefts when the weight is too heavy, depending on the height of the user. Furthermore, the weight holding device may also incorporate blocks, pegs, and the like that may be adjusted to automatically stop the handle bar at a predetermined height in the weight lifting device.

Optionally, a spring element connects the first weight holding means and the second weight holding means to the first holding bar and the second holding bar, respectively, and wherein the spring element provides a rotating force to rotate the handle bar for locking the first holding bar and the second holding bar. The term "spring element" as used herein refers to an elastic component or mechanism that could absorb, store and release energy through a change in shape. In this regard, the spring element is the locking mechanism that fastens with the fasteners such as a spring bolt. Notably, the spring element provides a high force output with minimal force requirements. It will be appreciated that the spring element provides a rotating force to rotate the handle bar for locking the first holding bar and the second holding bar of the weight lifting device. Optionally, the spring element may be fabricated from a metal i.e., copper, iron, beryllium, titanium, and the like. Optionally, the spring element may be fabricated from metal alloys, such as for example stainless steel, carbon steel, chrome silicon (chromium and silicon alloy), chrome vanadium (chromium and vanadium alloy), elgiloy (cobalt, chromium and nickel alloy) phosphor bronze, brass, and the like. It will be appreciated that the spring element could be fabricated from rubber and/or plastic, for example plastic composites, polyphenylene sulfide, Acrylonitrile butadiene styrene (ABS), nylon, acrylic, polyamide-imide (PAI) and the like. Moreover, optionally, the spring element may be fabricated from any combination of metals, metal alloys, plastics and rubber materials, and so forth. Optionally, the springs are fabricated using material such as spring steel. Notably, the fabrication material must have properties like high strength, high elastic limit and a low modulus to store the tension within. The spring element are designed to undergo large deflections over the usage, the fabrication material must also have an extensive elastic range to perform efficiently throughout use. In an example, the spring element is used to prevent accidental dropping of the handle bar in case the user fails to hold the handle bar. Moreover, the spring element may be classified depending on the load force applied thereon. The spring used in the spring element may also be classified based on its shape.

Optionally, the weight lifting device may comprise shock absorbers placed on the base side of the housing. In this regard, the shock absorber may be used to absorb or dampen the compression and rebound of the lifting bar when the lifting bar is accidentally dropped by the user. Thus, the shock absorber prevents the user from getting injured while exercising and also prevents damaging of the weight lifting device. The shock absorber may be fabricated from rubber, neoprene, silicone, or shock-absorbing polymers. In an example, the shock absorber may be fabricated from a non-toxic and environment-friendly polymer called Sorbothane. The Sorbothane provides shock and vibration protection and is also impervious to moisture.

DETAILED DESCRIPTION OF THE DRAWINGS

Referring to FIG. 1, illustrated is a weight lifting device 100, in accordance with an embodiment of the present disclosure. The weight lifting device 100 comprises a housing 102 and a handle bar 104. The housing 102 comprises a first frame 106 and a second frame 108 having a first vertical channel 110 and a second vertical channel 112, respectively. The first vertical channel 110 and the second vertical channel 112 accommodate a first weight holding means 114 and a second weight holding means 116, respectively, wherein the first vertical channel 110 and the second vertical channel 112 are dimensioned so that the first weight holding means 114 and the second weight holding means 116 can move up and down when in use, in the first vertical channel 110 and the second vertical channel 112. The handle bar 104 of the weight lifting device 100 is pivotably connectable to the first weight holding means 114 and to the second weight holding means 116 from a first end 104A of the handle bar and a second end 104B of the handle bar, respectively.

Moreover, the weight lifting device 100 further comprises a lifting bar 118. The lifting bar 118 comprises at least one of a first holding bar (not shown), a second holding bar (not shown), a first pivotable arm 120, and a second pivotable arm 122, arranged between the pivotably connectable handle bar 104 and the first weight holding means 114 and the second weight holding means 116 in a certain sequence. As shown, the sequence of the lifting bar 118 comprises the first holding bar, the first pivotable arm 120, the handle bar 104, the second pivotable arm 122, and the second holding bar.

Furthermore, the weight lifting device 100 comprises a plurality of weights 124A and 124B. Moreover, the each of the first weight holding means 114 and the second weight holding means 116 have slots for inserting or removing the plurality of weights 124A and 124B. Typically, a user may lift the lifting bar 118 from the handle bar 104 that is pivotably connectable to the first weight holding means 114 and the second weight holding means 116, to lift up and lower down the weights 124A and 124B.

Figure 2:
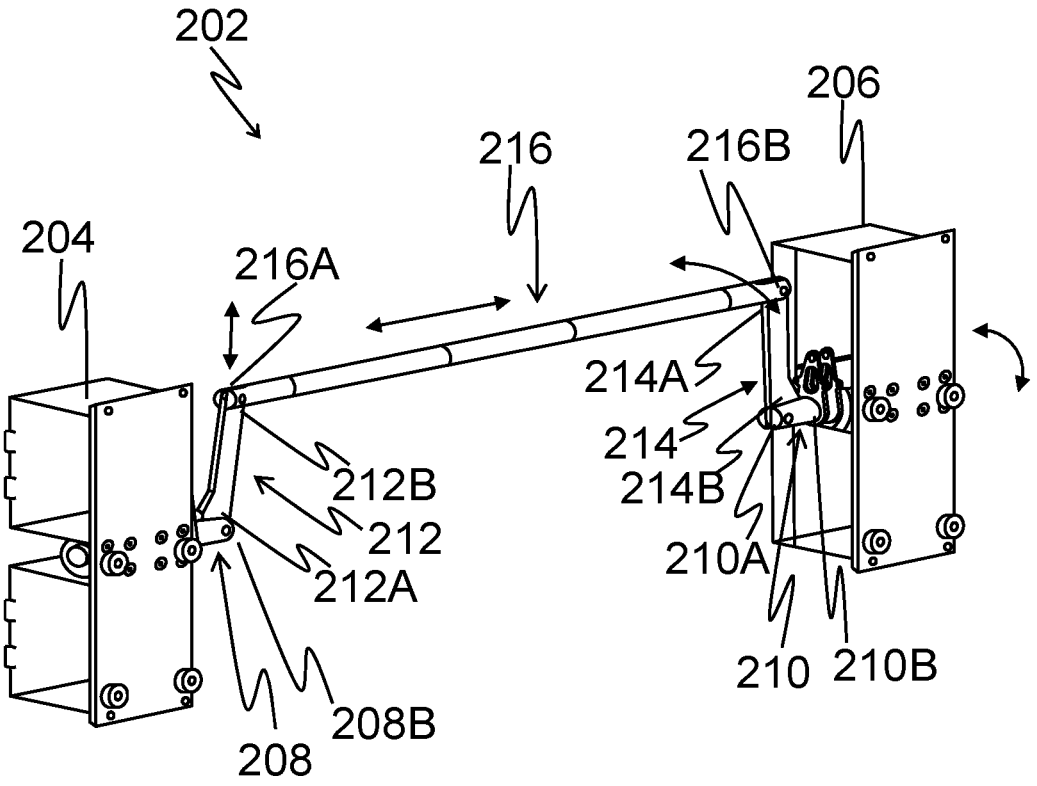
FIG. 2 is a schematic illustration of a lifting bar pivotably connectable to a first weight holding means and a second weight holding means of the weight lifting device, in accordance with an embodiment of the present disclosure.

Referring to FIG. 2, there is shown a schematic illustration of a lifting bar 202 (such as the lifting bar 118 as explained in FIG. 1) pivotably connectable to the first weight holding means 204 (such as the first weight holding means 114 as explained in FIG. 1) and to the second weight holding means 206 (such as the second weight holding means 116 as explained in FIG. 1) of the weight lifting device 100, in accordance with an embodiment of the present disclosure. As shown, the lifting bar 202 comprises the first holding bar 208, the second holding bar 210, the first pivotable arm 212, and the second pivotable arm 214, arranged between the pivotably connectable handle bar 216 (such as the handle bar 104 as explained in FIG. 1) and the first weight holding means 204 and the second weight holding means 206. Moreover, a sequence of the first holding bar 208, the first pivotable arm 212, the handle bar 216, the second pivotable arm 214 and the second holding bar 210 form the lifting bar 202. In this regard, the first end 216A of the handle bar 216 is connected to a second end 212B of the first pivotable arm 212, and a first end 212A of the first pivotable arm 212 is connected to a second end 208B of the first holding bar 208, and the first end (not shown) of the first holding bar 208 is connected to the first weight holding means 204. Similarly, the handle bar 216 is pivotably connectable to the second weight holding means 206 by the second holding bar 210 and the second pivotable arm 214. In this regard, the second end 216B of the handle bar 216 is connected to the first end 214A of the second pivotable arm 214, the second end 214B of the second pivotable arm 214 is connected to a first end 210A of the second holding bar 210, and the second end 210B of the second holding bar 210 is connected to the second weight holding means 206.

Figure 3:
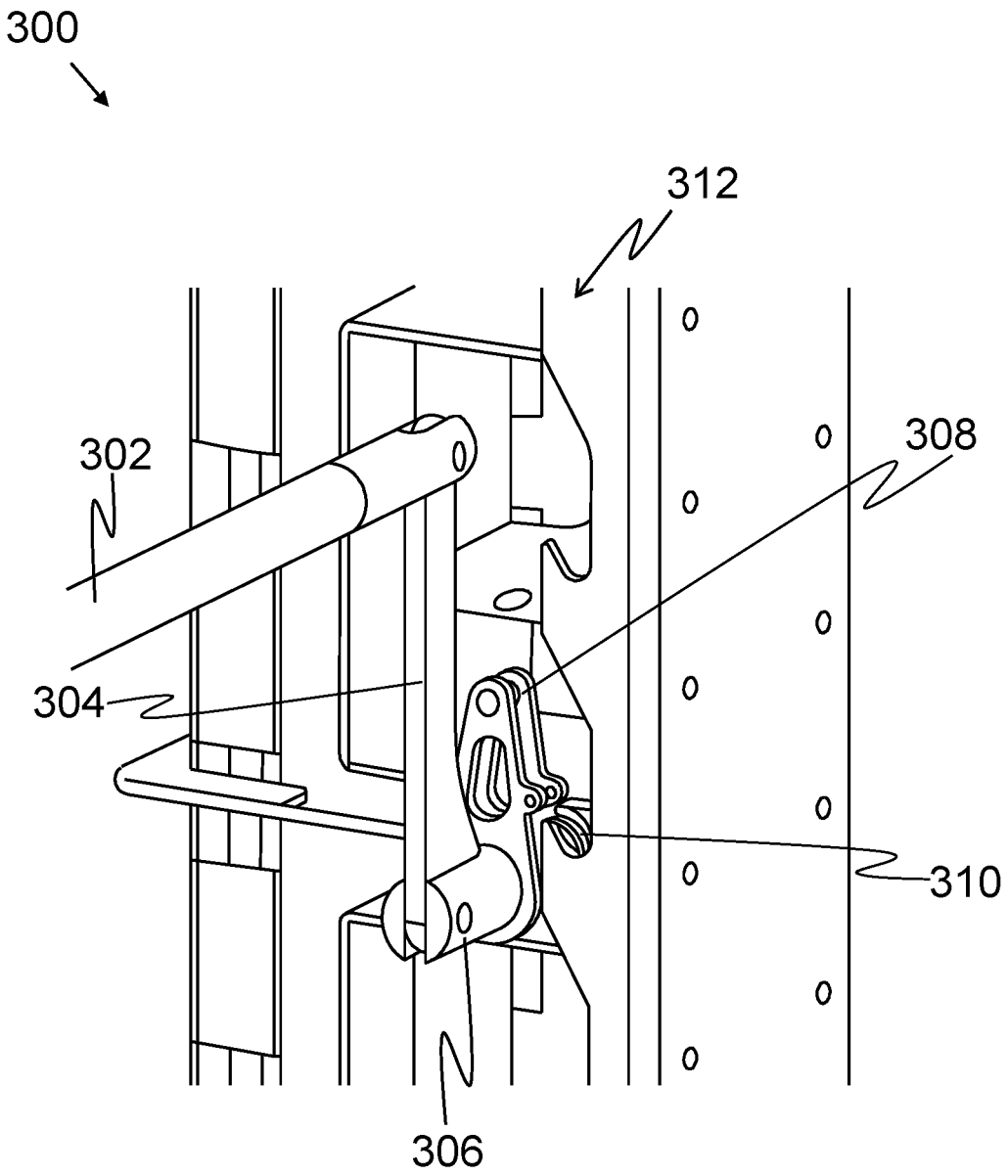
FIG. 3 is a sectional schematic view of a second frame of the weight lifting device, in accordance with an embodiment of the present disclosure.

Referring to FIG. 3, there is shown a sectional schematic view of a second frame 300 (such as the second frame 108 of FIG. 1) of the weight lifting device 100, in accordance with an embodiment of the present disclosure. As shown, the handle bar 302 is pivotably connectable with the second pivotable arm 304 that is further connected to the second holding bar 306. As shown, the second holding bar 306 comprises a locking mechanism 308. Moreover, via the locking mechanism 308, the second holding bar 306 locks into a corresponding indentation 310 within the second vertical channel 312, when the handle bar 302 is rotated upon use.

Figure 4:
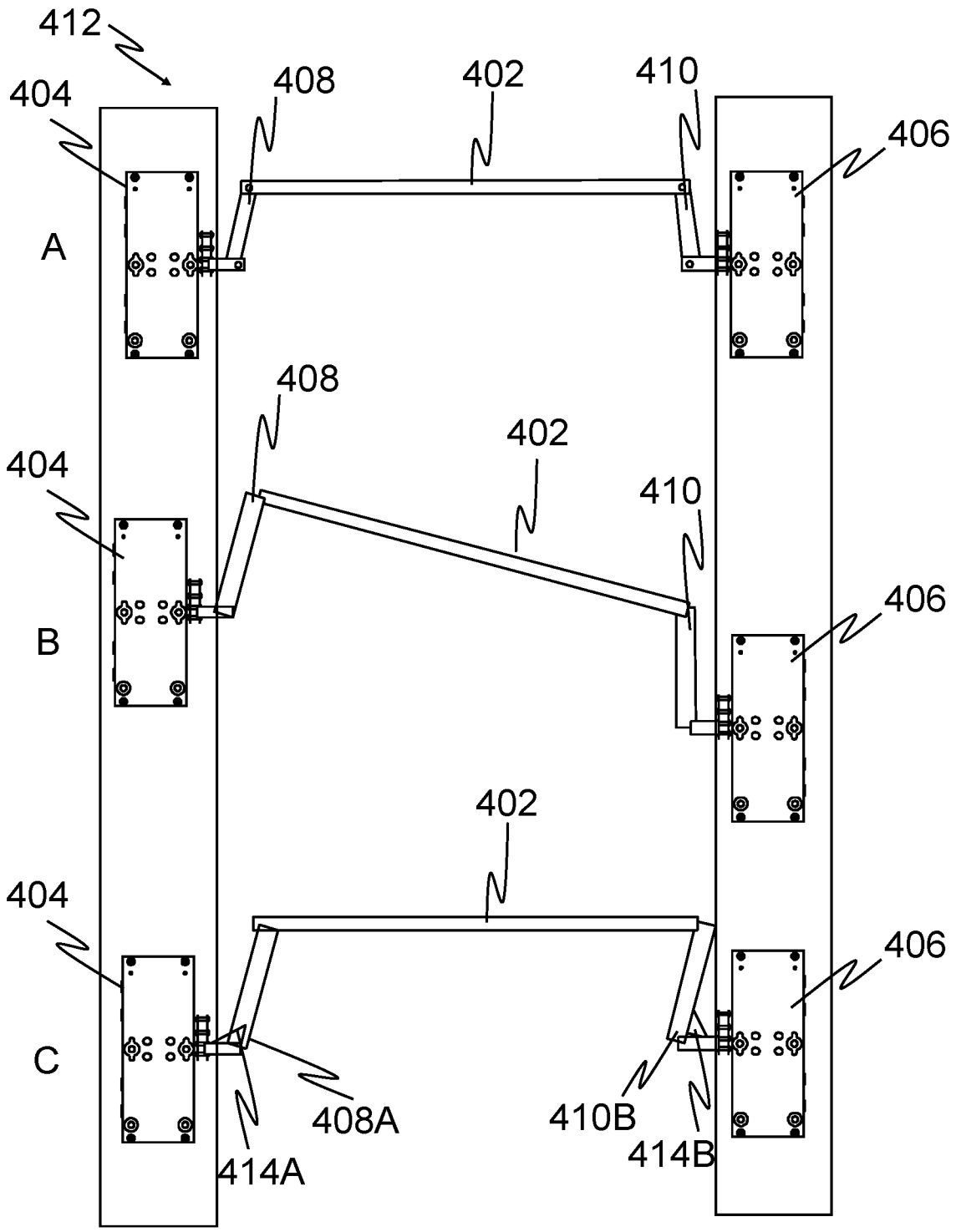
FIG. 4 is a schematic illustration of different orientations (A, B, and C) of a handle bar of the weight lifting device, in accordance with another embodiment of the present disclosure.

Referring to FIG. 4, there is shown a schematic illustration of different orientations (A, B, and C) of the handle bar 402 of the weight lifting device 100, in accordance with an embodiment of the present disclosure. As shown in the orientation A, the handle bar 402 is pivotably connectable with respect to the first weight holding means 404 and the second weight holding means 406 of the weight lifting device 100. It will be appreciated that the handle bar 402 is pivotably connectable with respect to the first weight holding means 404 and the second weight holding means 406 by the first pivotable arm 408 and the second pivotable arm 410 of the lifting bar 402.

As shown in the orientation B, the first pivotable arm 408 and the second pivotable arm 410 enables tilting of the handle bar 402 with respect to the housing 412.

As shown in the orientation C, the first pivotable arm 408 and the second pivotable arm 410 comprises a protruding portion 414A and a protruding portion 414B at the first end 408A of the first pivotable arm 408 and the second end 410B of the second pivotable arm 410, respectively, to prevent excess tilting of the handle bar 402 with respect to the housing 414 of the weight lifting device 100.

Figure 5:
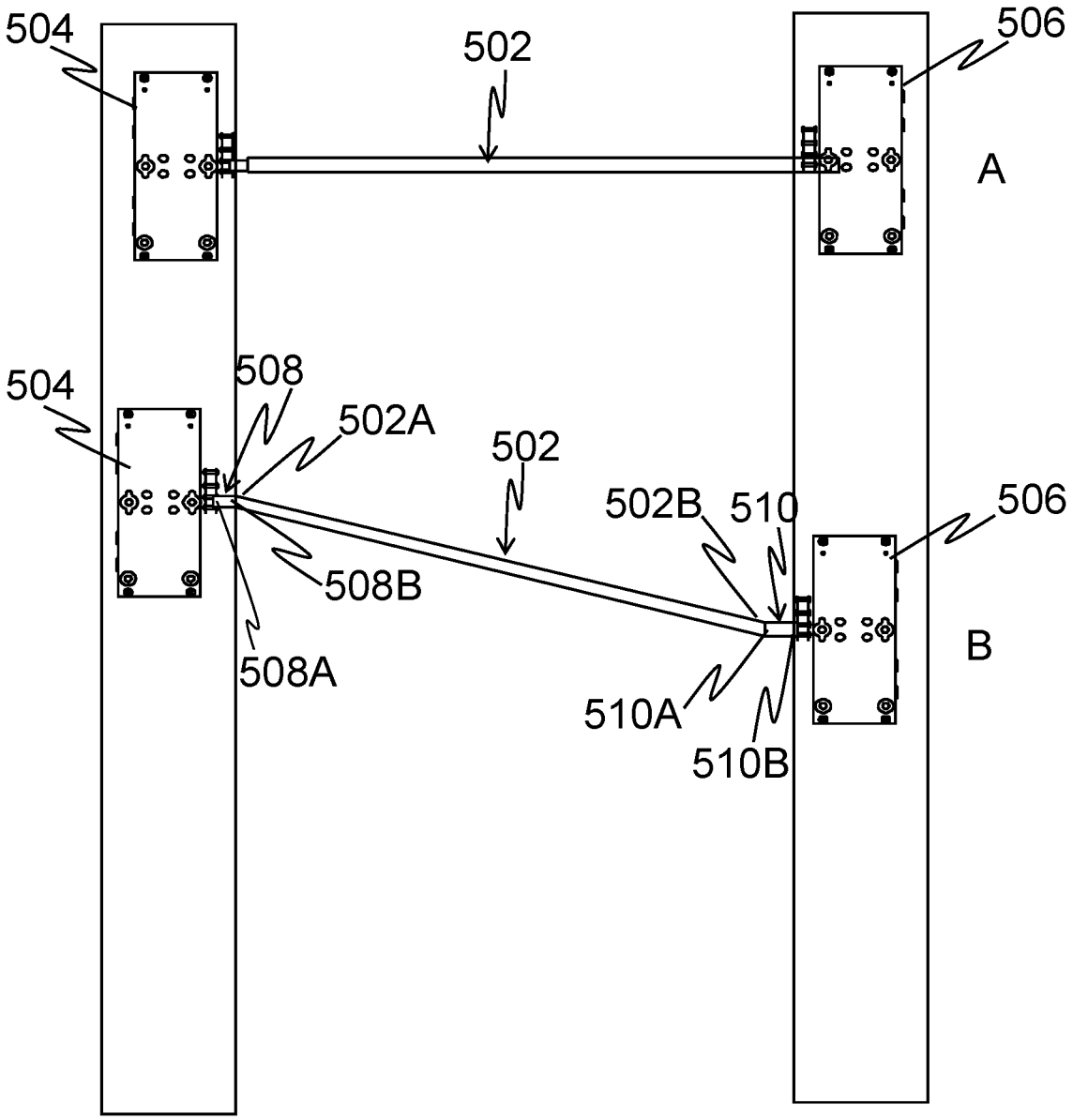
FIG. 5. is a schematic illustration of different orientations (A and B) of a handle bar of the weight lifting device, in accordance with another embodiment of the present disclosure.

Referring to FIG. 5, there is shown a schematic illustration of different orientations (A and B) of a handle bar 502 of the weight lifting device 100, in accordance with an embodiment of the present disclosure. As shown in the orientation A, the handle bar 502 is pivotably connectable to a first weight holding means 504 and a second weight holding means 506. Moreover, as shown in the orientation B, the handle bar 502 is pivotably connectable to the first weight holding means 504 by the first holding bar 508 such that the first end 502A of the handle bar 502 is connected to a second end 508B of the first holding bar 508, and a first end 508A of the first holding bar 508 is connected to the first weight holding means 504. The handle bar 502 is pivotably connectable to the second weight holding means 506 by the second holding bar 510 such that a second end 502B of the handle bar 502 is connected to a first end 510A of a second holding bar 510, and the second end 510B of the second holding bar 510 is connected to the second weight holding means 506 of the weight lifting device 100.

Figure 6:
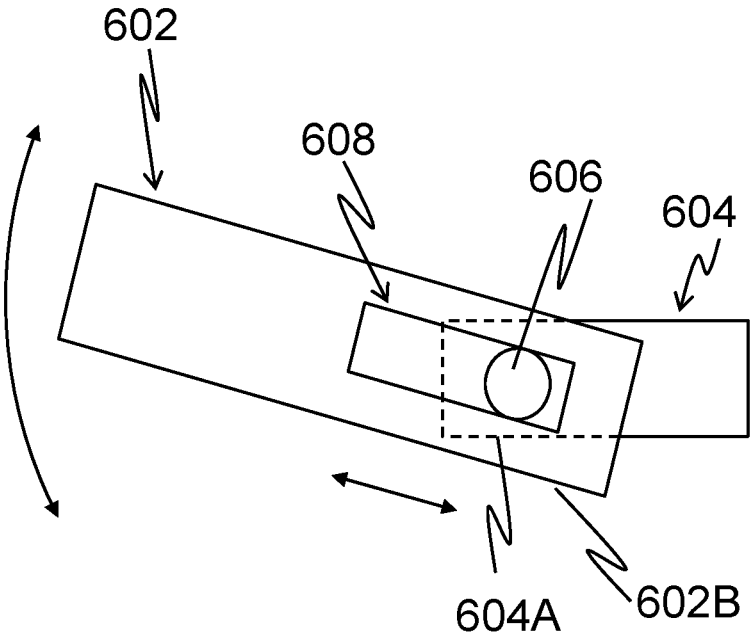
FIG. 6 is a schematic illustration of a pivotably connectable arrangement of a handle bar with the second holding bar, in accordance with an embodiment of the present disclosure.

Referring to FIG. 6, there is shown a schematic illustration of a pivotably connectable arrangement of a handle bar 602 with the second holding bar 604, in accordance with an embodiment of the present disclosure. As shown, a second end 602B of the handle bar 602 is connected to a first end 604A of the second holding bar 604 using fasteners 606. As shown, the fastener 606 is a bolt. In this regard, the handle bar 602, as shown, have an elongated opening 608 at the end where the fastener 606, couples with the handle bar 602 to the second holding bar 604. The fastener 606 is attached such that it allows the movement of the handle bar 602 to move with respect to the second holding bar 604.

Figure 7:
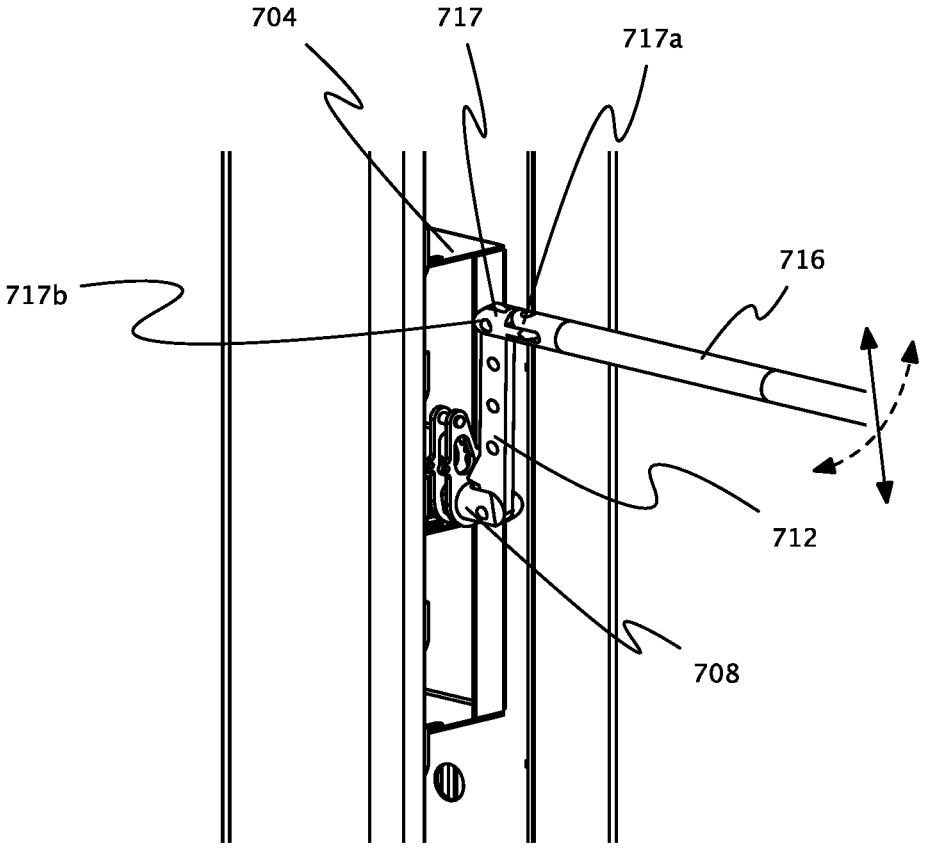
FIG. 7 is a schematic illustration of pivoting arrangement in accordance with an embodiment of the present disclosure.

Referring to FIG. 7, there is shown a schematic illustration of (a first side of) an arrangement (second side is symmetrical to the first side). A first weight holding means 704 is pivotably connected to a lifting bar via a first holding bar 708. The first holding bar is pivotable connected to a first pivotable arm 712. The first pivotable arm 712 is connected with a first double pivoting element 717 to a first end of the handle bar. The first double pivoting element 717 has a first pivoting point 717*b* to enable tilting of the lifting bar in first direction (indicated with solid line arrow in the figure) and a second pivoting point 717*a* for tiling the lifting bar in a second direction (indicated with dashed line arrow in the figure). The second direction is preferably perpendicular to the first direction. This arrangement provides further freedom of movements for the user of the weight lifting device.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A weight lifting device comprising:

a housing, having a first frame having a first vertical channel for accommodating a first weight holding means, and a second frame having a second vertical channel for accommodating a second weight holding means, wherein the first vertical channel and the second vertical channel are dimensioned so that the first weight holding means and the second weight holding means can move up and down, when in use, in the first vertical channel and the second vertical channel, respectively; and a handle bar pivotably connectable to the first weight holding means and to the second weight holding means from a first end of the handle bar and a second end of the handle bar, respectively.

2. The weight lifting device according to claim 1, further comprising at least one of: a first holding bar, a second holding bar, a first pivotable arm, and a second pivotable arm, arranged between the pivotably connectable handle bar and the first weight holding means and the second weight holding means, wherein the first holding bar, the second holding bar, the first pivotable arm, the second pivotable arm, and the handle bar form a lifting bar.

3. The weight lifting device according to claim 1, wherein the handle bar is pivotably connectable to:

the first weight holding means by the first holding bar such that the first end of the handle bar is connected to a second end of the first holding bar, and the first end of the first holding bar is connected to the first weight holding means; and the second weight holding means by the second holding bar such that the second end of the handle bar is connected to a first end of the second holding bar, and the second end of the second holding bar is connected to the second weight holding means, and wherein the first end of the first holding bar and the second end of the second holding bar is the first end of the lifting bar and the second end of the lifting bar, respectively.

4. The weight lifting device according to claim 1, wherein the first end of the handle bar is connected to a second end of the first holding bar and the second end of the handle bar is connected to a first end of the second holding bar using fasteners.

5. The weight lifting device according to claim 1, wherein the handle bar is pivotably connectable to:

the first weight holding means by the first holding bar (208, 508) and the first pivotable arm, wherein the first end of the handle bar is connected to a second end of the first pivotable arm, a first end of the first pivotable arm is connected to a second end of the first holding bar, and the first end of the first holding bar is connected to the first weight holding means; and the second weight holding means by the second holding bar and the second pivotable arm, wherein the second end of the handle bar is connected to the first end of the second pivotable arm, the second end of the second pivotable arm is connected to a first end of the second holding bar, and the second end of the second holding bar is connected to the second weight holding means, and wherein the first end of the first holding bar and the second end of the second holding bar is the first end of the lifting bar the second end of the lifting bar, respectively.

6. The weight lifting device according to claim 1, wherein each of the first end of the first holding bar is connected to the first weight holding means and the second end of the second holding bar is connected to the second weight holding means using ball bearings.

7. The weight lifting device according to claim 1, wherein a user holds the lifting bar from the handle bar that is pivotably connectable to the first weight holding means and the second weight holding means, to lift up and lower down the weights, when in use, in the first vertical channel and the second vertical channel, respectively.

8. The weight lifting device according to claim 1, wherein the pivotably connectable handle bar and the first weight holding means and the second weight holding means provides various freedoms of movements of the handle bar in respect of the housing of the weight lifting device.

9. The weight lifting device according to claim 1, wherein various freedoms of movements are selected from at least one of: an upward movement, a downward movement, sideways movement, a tilting movement, a rotating movement, or a shaking movement.

10. The weight lifting device according to claim 1, wherein each of the first pivotable arm and the second pivotable arm comprise a protruding portion at the first end of the first pivotable arm and the second end of the second pivotable arm, respectively, to prevent excess tilting of the handle bar with respect to the housing of the weight lifting device.

11. The weight lifting device according to claim 1, wherein each of the first holding bar and the second holding bar comprise a locking mechanism.

12. The weight lifting device according to claim 1, wherein the locking mechanism of each of the first holding bar and the second holding bar locks into a corresponding indentation within the first vertical channel and the second vertical channel, respectively, when the handle bar is rotated upon use.

13. The weight lifting device according to claim 1, wherein a spring element connects the first weight holding means and the second weight holding means to the first holding bar and the second holding bar, respectively, and wherein the spring element provides a rotating force to rotate the handle bar for locking the first holding bar and the second holding bar.

14. The weight lifting device according to claim 1, wherein each of the first weight holding means and the second weight holding means have slots for inserting or removing a plurality of weights.

* * * * *